US005293175A

United States Patent [19]

Hemmie et al.

[11] Patent Number: 5,293,175

[45] Date of Patent: * Mar. 8, 1994

[54] STACKED DUAL DIPOLE MMDS FEED

[75] Inventors: Dale L. Hemmie, Burlington, Iowa; Robert M. Evans, Hightstown, N.J.

[73] Assignee: Conifer Corporation, Burlington, Iowa

[ * ] Notice: The portion of the term of this patent subsequent to Jul. 20, 2010 has been disclaimed.

[21] Appl. No.: 31,522

[22] Filed: Mar. 15, 1993

Related U.S. Application Data

[63] Continuation of Ser. No. 733,108, Jul. 19, 1991, Pat. No. 5,229,782.

[51] Int. Cl.[5] ..... H01Q 9/28; H01Q 19/19

[52] U.S. Cl. ..... 343/795; 343/840; 343/821; 343/822

[58] Field of Search ..... 343/795, 906, 793, 821, 343/822, 700 MS, 840

[56] References Cited

U.S. PATENT DOCUMENTS

| | | | |
|---|---|---|---|
| 3,587,110 | 6/1971 | Woodward | 343/814 |
| 3,747,114 | 7/1973 | Shyhalla | 343/795 |
| 3,887,925 | 6/1975 | Ranghelli et al. | 343/795 |
| 4,736,207 | 4/1988 | Siikarla et al. | 343/700 MS |
| 4,758,843 | 7/1988 | Agrawal et al. | 343/795 |
| 4,812,855 | 3/1989 | Coe et al. | 343/700 MS |
| 4,866,451 | 9/1989 | Chen | 343/700 MS |
| 5,202,699 | 4/1993 | Hemmie et al. | 343/795 |

*Primary Examiner*—Donald Hajec
*Assistant Examiner*—Tan Ho
*Attorney, Agent, or Firm*—Dorr, Carson, Sloan & Peterson

[57] ABSTRACT

A multichannel, multipoint distribution services (MMDS) dipole antenna for receiving multiple channels in the S-band frequency range of 2000 and 3000 MHz is formed from a printed circuit board which is directly connected to a coaxial cable. On the printed circuit board are etched two stacked dipoles. Each of the dipoles has a first one-half element etched on the first side of the printed circuit board and the second one-half element etched on the second side of the printed circuit board. The first and second dipoles are oriented to be in phase with each other and are separated from each other at a wavelength spacing between 0.25 lambda and 0.40 lambda. The antenna of the present invention further uses a phase combining circuit and an impedance matching circuit etched on the printed circuit board for combining in phase the polarized signals, for canceling the non-polarized signals at 0° and 180°, from the two stacked dipoles and for matching the impedance from the two dipoles to the impedance of the coaxial cable.

37 Claims, 10 Drawing Sheets

STACKED DUAL DIPOLE MMDS FEED

This is a continuation of copending application(s) Ser. No. 07/733,108 filed on Jul. 19, 1991, now U.S. Pat. No. 5,229,782.

BACKGROUND OF THE INVENTION

1. Related Application

This is related to a patent entitled "Low Wind Load Parabolic Antenna", Ser. No. 07/732,651 filed Jul. 19, 1991, filed concurrently with this application.

2. Field of the Invention

The present invention is related to the field of microstrip antennas and feeds and, in particular, to a stacked dual dipole feed for a multichannel multipoint distribution service (MMDS) parabolic antenna.

3. Statement of the Problem

Significant goals of the MMDS industry are to provide rooftop antennas having (1) the lowest possible manufacturing costs with consistently uniform performance, (2) high gain, (3) high directivity, and (4) high levels of rejection for cross-polarized signals. An example of a prior MMDS antenna is the Conifer Model PT-1000 which is disclosed in U.S. Pat. No. 4,295,143, commonly owned by the assignee of the present invention.

A need exists for an MMDS antenna having a sharper more directive feed and antenna patterns for improved rejection of unwanted signals. A need further exists for obtaining higher gain from a given size main reflector and having an improved voltage standing wave ratio (VSWR) over the full bandwidth. A need further exists to improve the balance to unbalance transition from the feed to coaxial cable connection.

Finally, a need exists to use fewer parts to assemble the feed so as to reduce labor costs. Present manufacturing processes rely on human skill in the assembly of the feed components. Hence, human error enters the assembly process and quality control must be used to ferret out and minimize such human error. This adds to the cost of the feed. Such human assembled feeds are also inconsistent in performance.

4. Solution to the Problem

The stacked dual dipole feed of the present invention is of one piece construction and does not utilize any external components. This eliminates the human error factors found in prior art feeds and provides a manufactured feed of consistent performance. The dual dipole feed of the present invention utilizes a pair of stacked dipoles etched onto a printed circuit board which directly couples with a coaxial cable. The stacked dipole design exhibits a narrowed lobe which provides greater directivity and, therefore, greater gain. In addition, the stacked dipole antenna minimizes cross polarization with minimal operating side lobes. Finally, the present invention integrates a phasing power combiner and a matching network to an unbalanced coaxial cable. A sub-reflector is also used to enhance the performance of the stacked dual dipole feed.

SUMMARY OF THE INVENTION

A multichannel multipoint distribution service dipole antenna for receiving multiple channels in a frequency range of 2000 and 3000 MHz is etched on a printed circuit board which is directly connected to a coaxial cable. On the printed circuit board are etched two stacked dipoles. Each of the dipoles has a first one-half element etched on the first side of the printed circuit board and the second one-half element etched on the second side of the printed circuit board. The first and second dipoles are oriented to have the polarized signals in phase with each other and to have the non-polarized signals canceling at 0° and 180°. The dipoles are separated from each other at a wavelength spacing between 0.25 lambda and 0.40 lambda.

A first conductive trace interconnects the first one-half elements of each of the two dipoles together with the first conductive trace being etched along the center line of the antenna on the first side of the printed circuit board. A first circular conductive pad is etched with the first conductive trace at the midpoint between the two stacked dipoles on the first side.

A second conductive trace interconnects the two second one-half elements of the two dipoles together with the second conductive trace being etched along the center line on the second side of the printed circuit board. A second circular conductive pad is printed on the second conductive trace directly opposing the first circular conductive pad. A hole is centrally formed through the first circular conductive pad, the printed circuit board, and the second circular conductive pad at the center of the antenna.

In one embodiment, the coaxial cable has its inner conductor passing through the formed hole to connect to the second circular conductive pad and has its ground shield connected to the first circular conductive pad. The connection of the coaxial cable to the printed circuit board provides substantial structural support to the printed circuit board when mounted in the antenna feed.

The antenna of the present invention further uses a phase combining circuit for the polarized signals (phase canceling for the non-polarized signals at 0° and 180°) and an impedance matching circuit formed with the second circular trace and second circular conductive pad between each of the second one-half elements for combining the signals from the two stacked dipoles in phase and for matching the impedance from the two dipoles to the impedance of the coaxial cable.

Figure 12:
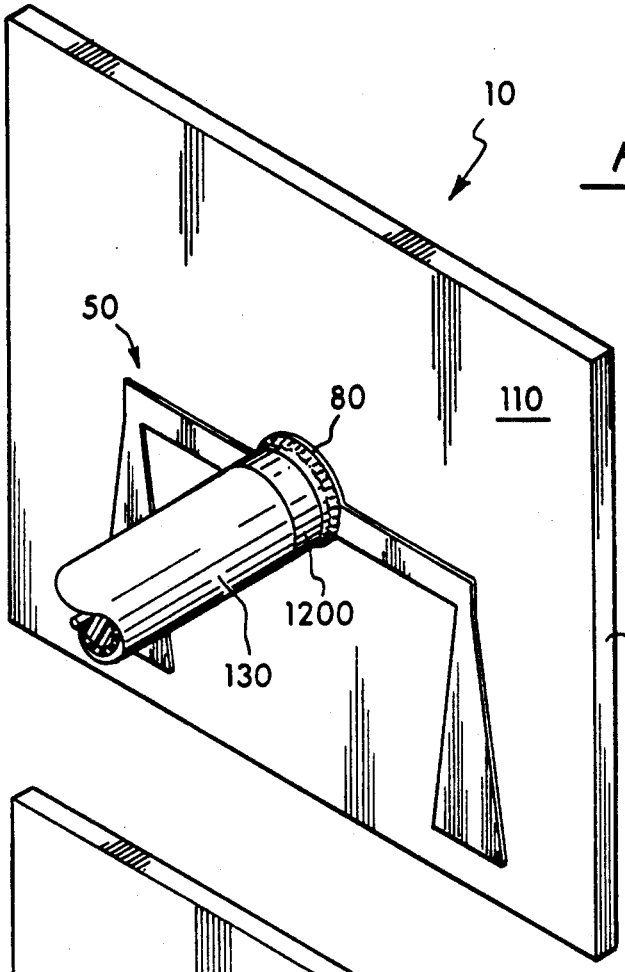
Figure 13:
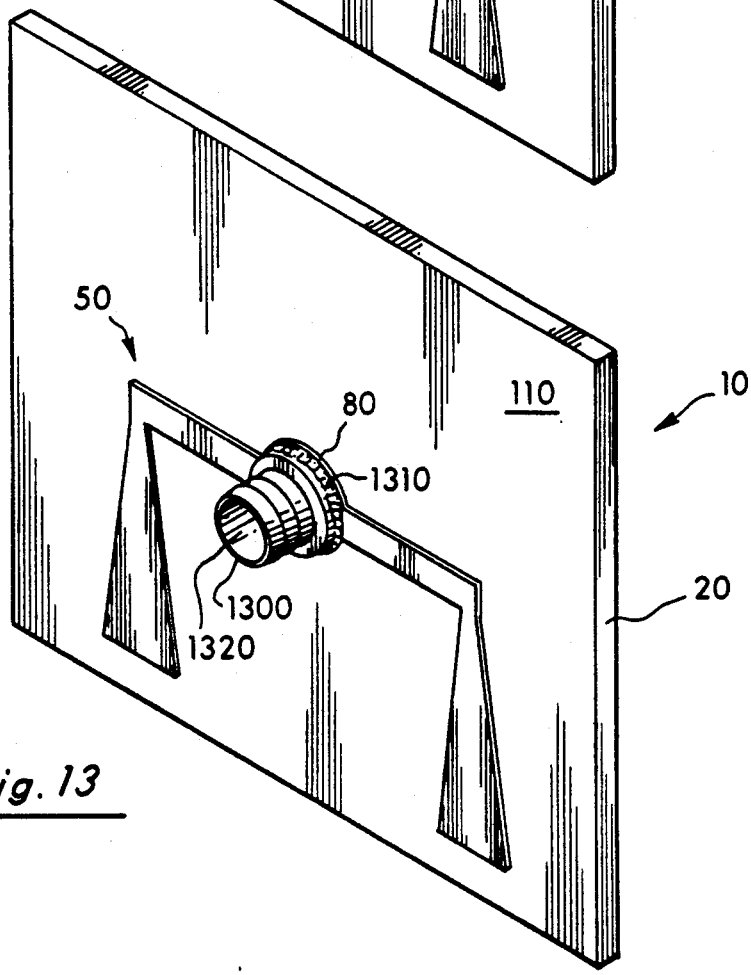
Figure 14:
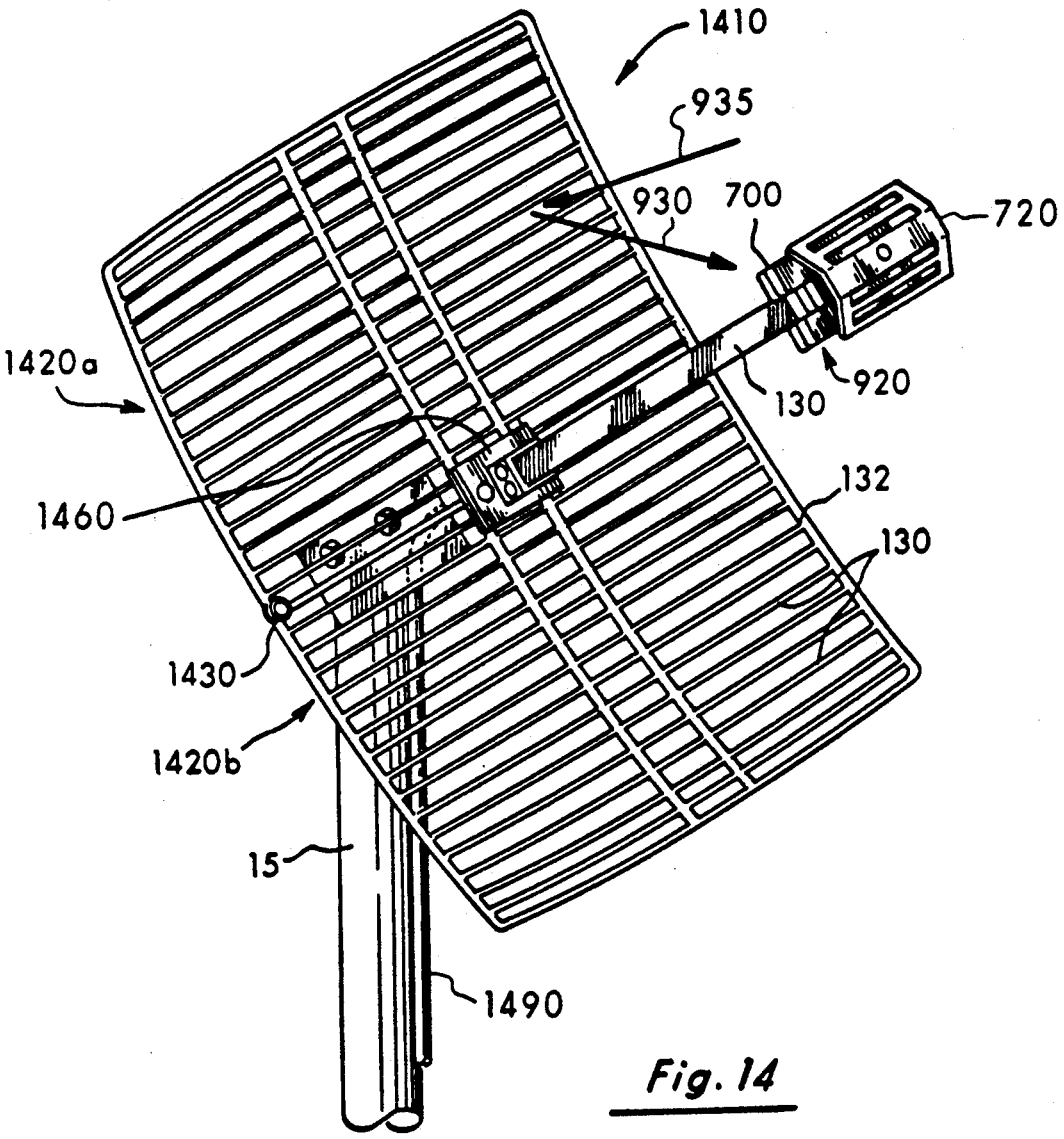
Figure 15:
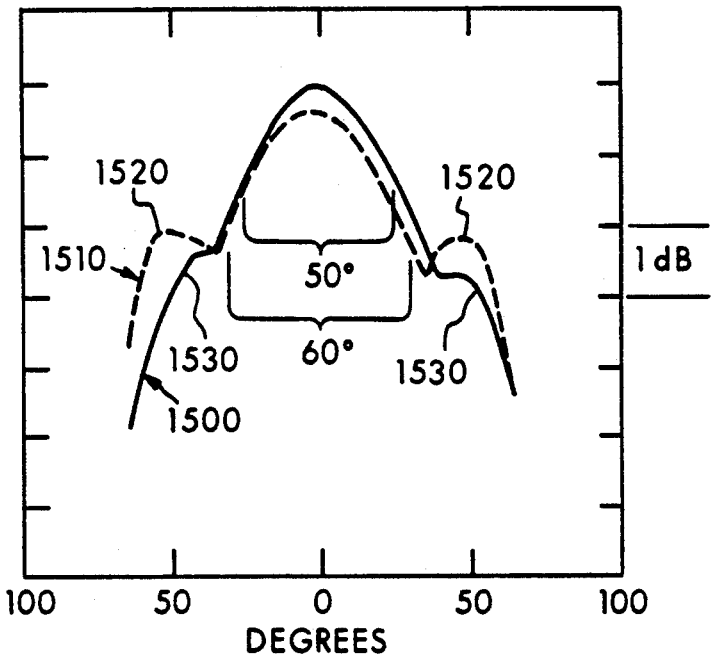

FIGURE is a polar pattern for the present invention;

FIG. 12 is a perspective view of the front of the stacked dual dipole feed of the present invention interconnected to a coaxial cable crimped onto a barrel connector;

FIG. 13 is a perspective view of the barrel connector of FIG. 12 soldered to the stacked dual dipole feed;

FIG. 14 illustrates the mounting of the stacked dual dipole feed of the present invention into a semiparabolic reflector; and FIG. 15 sets forth the plots showing the side lobe characteristics with and without optimum spacing of the sub-reflector.

DETAILED SPECIFICATION

1. Overview of Stacked Dual Dipole Feed 10

Figure 1:
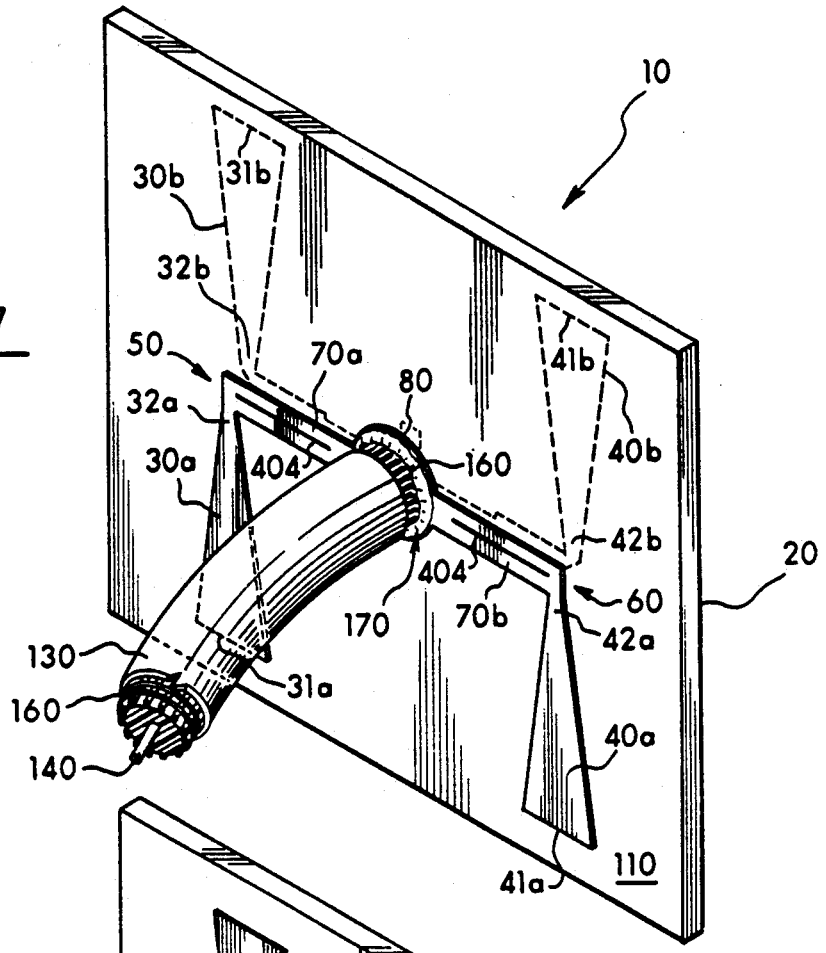
FIG. 1 is a perspective view of the front of the stacked dual dipole feed of the present invention.
Figure 2:
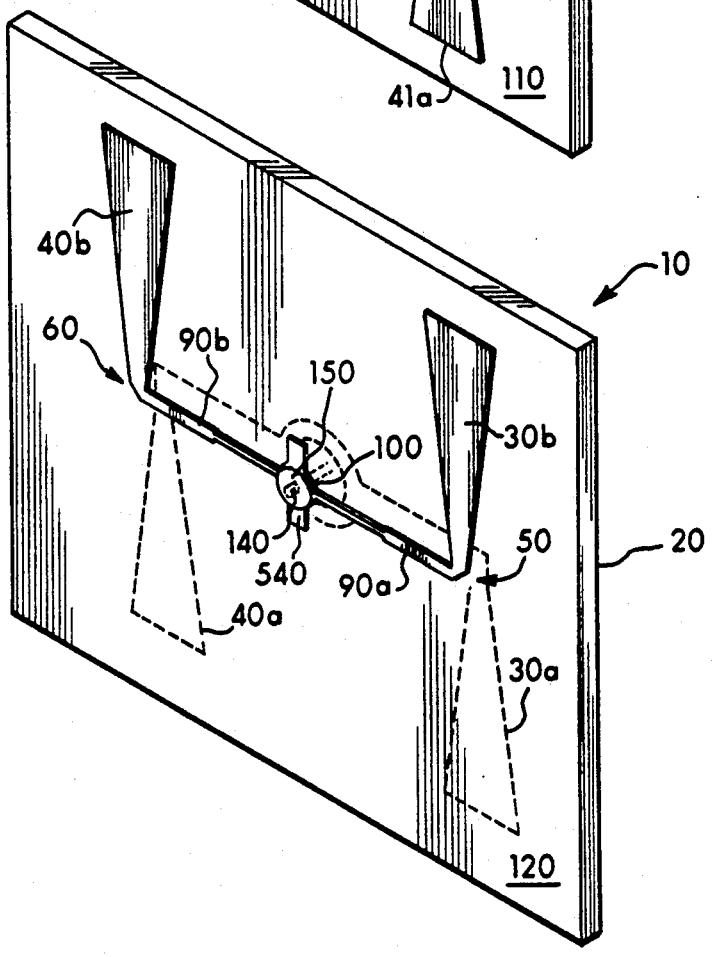
FIG. 2 is a perspective view of the back of the stacked dual dipole feed of the present invention.

In FIGS. 1 and 2, the dual dipole feed. 10 of the present invention is set forth. The feed includes a thin printed circuit board (PCB) 20 on which is etched, in copper, stacked dipoles in the form of bow ties or butterflies 30*a*–30*b*, and 40*a*–40*b*. Bow tie 30*a*–30*b* forms a first dipole 50 and bow tie 40*a*–40*b* forms a second dipole 60. Dipoles 50 and 60 form the stacked dual dipole configuration of the present invention.

Front bow tie halves 30*a* and 40*a* are connected via lines or traces 70*a* and 70*b* to an outer circular ring 80. Rear bow tie halves 30*b* and 40*b* are connected via traces or lines 90*a* and 90*b* to an inner circular ring 100. Hence, on the front 110 of the PCB 20 the copper bow tie halves 30*a* and 40*a* and the copper traces 70*a* and 70*b* as well as the outer circular ring 80 remain after etching. On the back 120 of the PCB 20 are etched the bow tie halves 30*b* and 40*b*, the traces 90*a* and 90*b*, and the inner circular ring 100. Each element half 30*a*, 30*b*, 40*a*, 40*b* is formed in the shape of an isosceles triangle having the unequal sides 31*a*, 31*b*, 41*a*, 41*b* extending outwardly from the centerline 404 of the dipoles 50, 60. Traces 70 and 90 are etched on the centerline 404 to interconnect the apexes 32*a*, 32*b*, 42*a*, 42*b* as in FIG. 1.

In a first embodiment shown in FIGS. 1 and 2, a coaxial cable 130 is directly connected to the PCB 20 in the following fashion. The inner conductor 140 of the coaxial cable passes through a formed hole in the PCB 20 and is soldered 150 to the inner ring 100. The outer mesh conductor 160 of coaxial cable 130 is connected to the outer ring 80 by means of solder 170.

In FIGS. 12 and 13 is shown a second embodiment for mounting the coaxial cable 130 to the printed circuit board 20. As shown in FIG. 13, a barrel connector 1300 is connected to the circular pad 80 by means of solder 1310. The barrel connector 1300 has a formed hole 1320 there through which it aligns with the corresponding formed hole 300 through the printed circuit board 2 . The coaxial cable 130 is then mounted to the barrel connector 1300 in a conventional fashion by means of a crimp ring 1200 as shown in FIG. 12. In this fashion, outer ground conductor of the coaxial cable connects with the barrel connector 1300 by means of the crimp ring 1200 and the inner conductor is connected to the inner ring 100 as set forth in the above embodiment. The approach set forth in FIGS. 12 and 13 is easier to implement in a manufacturing process although it has the disadvantage of requiring an extra part (i.e., the barrel 1300).

As can be witnessed in FIGS. 1 and 2, the stacked dual dipole feed of the present invention is elegantly simple in design, provides a direct coaxial cable connection to the stacked dual dipoles 50 and 60, and requires no other components (i.e., resistors, capacitors, inductors, etc.) to be placed on the board. Essentially, only two parts for the dual dipole feed are required under the teachings of the first embodiment and only three components are required under the second embodiment. The etched PC board 20 and the coaxial cable 130 and, optionally, the barrel connector 1300.

In the preferred embodiment, the PC board is double sided G-10 which is an inexpensive conventionally available PCB material. The coaxial cable 130, in the preferred embodiment, is conventionally available as RG-8.

2. Coaxial Cable 130 Connection

Figure 3:
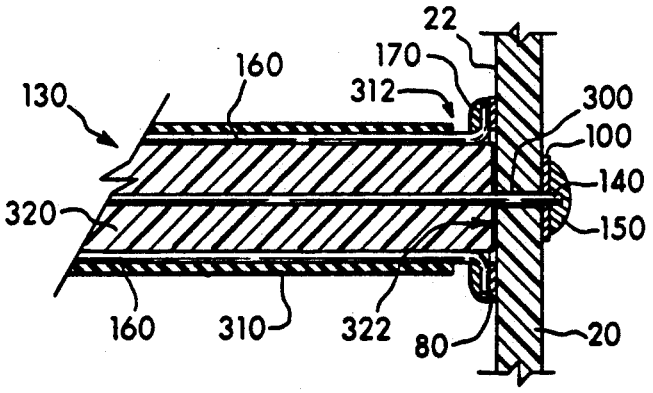
FIG. 3 is a cross-section showing the connection of the coaxial cable to the stacked dual dipole feed of the present invention.

In FIG. 3, the details of the first embodiment (FIGS. 1 and 2) showing the coaxial cable 130 directly connected with the PCB 20 and the dual dipole feed 10 of the present invention are set forth. In FIG. 3, a hole 300 is formed through the PCB 20. The outer insulation 310 of the coaxial cable 130 is cut back to point 312. Point 312 can be located to abut solder 170 or anywhere near the solder 170. This allows the outer mesh conductor 160 to be bent back and soldered 170 to the outer ring 80. The inner insulation 320 is cut at point 322 to allow the inner insulation to butt up against the outer surface of the PCB 20 which also adds to the structural support of the connection. The inner conductor 140 passes through the hole 300 and is soldered 150 to the inner ring 100.

In viewing FIG. 3, it can be appreciated that the outer ring 80 and the inner ring 100 when soldered to the outer mesh conductor 160 and the inner conductor 140 provide sturdy structural support for the connection of the coaxial cable 130 to PCB 20. It is to be expressly understood that the inner conductor 140 is soldered 150 to the inner ring 100 wherein the solder 150 is uniformly placed around the inner conductor 140 so that the uniform circular connection is made around ring 100. Likewise, the outer mesh 160 is soldered 170 in a uniform circular fashion around ring 80.

The coaxial cable 130 as set forth above, can be connected to the stacked dipoles 50, 60 on PCB 20 in one of two approaches. Both approaches result in a strong structural connection of the coaxial cable 130 to the stacked dipoles 50 and 60. It is to be kept in mind that the stacked dual dipole feed of the present invention is typically mounted in a parabolic antenna on the rooftop of a building. This is a high wind load environment and the antenna, of necessity, endures substantial stress and vibration. The connection between the coaxial cable 130 and the stacked dual dipoles of the present invention must be structurally solid. Both embodiments provide direct connections between the coaxial cable 130 and the dipoles 50, 60. The second embodiment as shown in FIGS. 12 and 13, even though requiring an extra component in the form of a barrel connector, is easier and, therefore, less costly to manufacture. The present invention is not to be limited to the use of one embodiment over the other.

3. Construction of the Dual Dipoles 50 and 60

Figure 4:
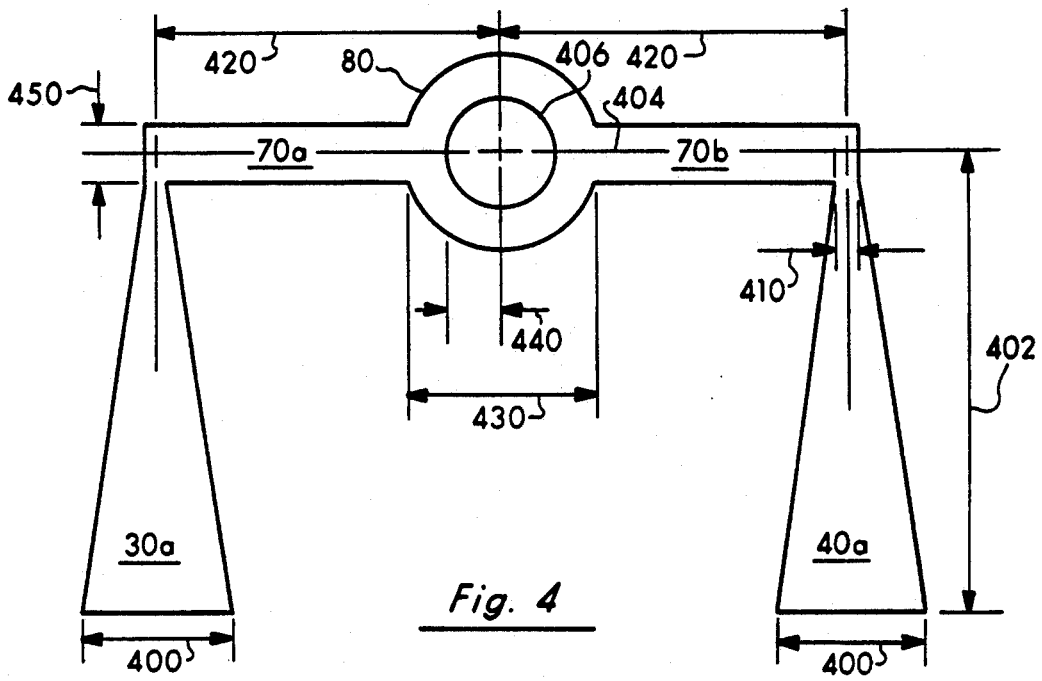
FIG. 4 is an illustration of the front of the stacked dual dipole feed of the present invention showing the critical dimensions thereof.
Figure 5:
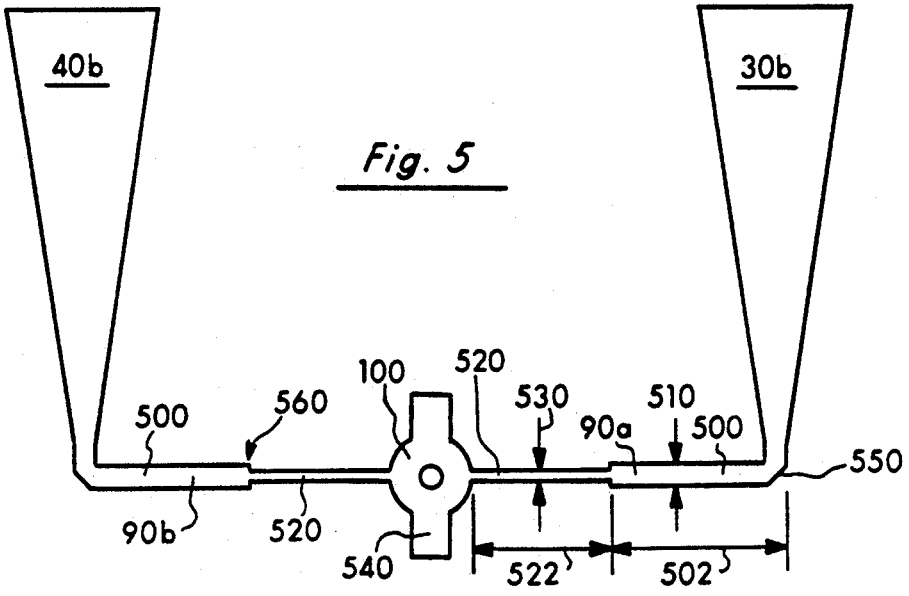
FIG. 5 is an illustration of the rear of the stacked dual dipole feed of the present invention showing the critical dimensions thereof.

In FIGS. 4 and 5, the details of the art work mask for the PC board 20 are set forth. As stated, the dipoles 50 and 60 are etched in copper on both sides of the two sided copper clad PCB 20.

In FIG. 4, the etching design for a first portion of the feed formed on the front 110 of the PCB 20 is shown. Dipole half elements 30*a* and 40*a* have a lower width 400 of about 0.400 inches and a tapered width 410 of 0.050 inches. The length 402 of each half element to the center 404 of trace 70 is about 1.210 inches. Each half-trace 70*a*, 70*b* has a length 420 of about 0.930 inches as measured from the center 406 of outer ring 80. The outer circular ring 80 has a diameter 430 of about 0.500 inches and an inner radius 440 of about 0.150 inches. The half-traces 70*a* and 70*b* have a width 450 of about 0.150 inches.

In FIG. 5, the etching details for a second portion of the feed formed on the rear 120 of PCB 20 is set forth. The element halves 30*b* and 40*b* have the same dimensional configuration as element halves 30*a* and 40*a* in FIG. 4. Each half-trace 90*a*, 90*b* has a first region 500 having a length 502 of about 0.450 inches and a width 510 of about 0.050 inches. The second region 520 has a length 522 of about 0.350 inches and a width 530 of about 0.025 inches. The inner circle 100 has an outer radius of about 0.110 inches and an inner radius of about 0.050 inches. Outwardly extending on both sides of the inner ring 100 and orthogonal to trace 90 is a shunt trim capacitor 540 having a size of 0.100 by 0.219 inches. At the terminal ends of traces 90, the traces have a transition angle 550 of 45 degrees towards the element halves 30*b* and 40*b*.

Figure 6:
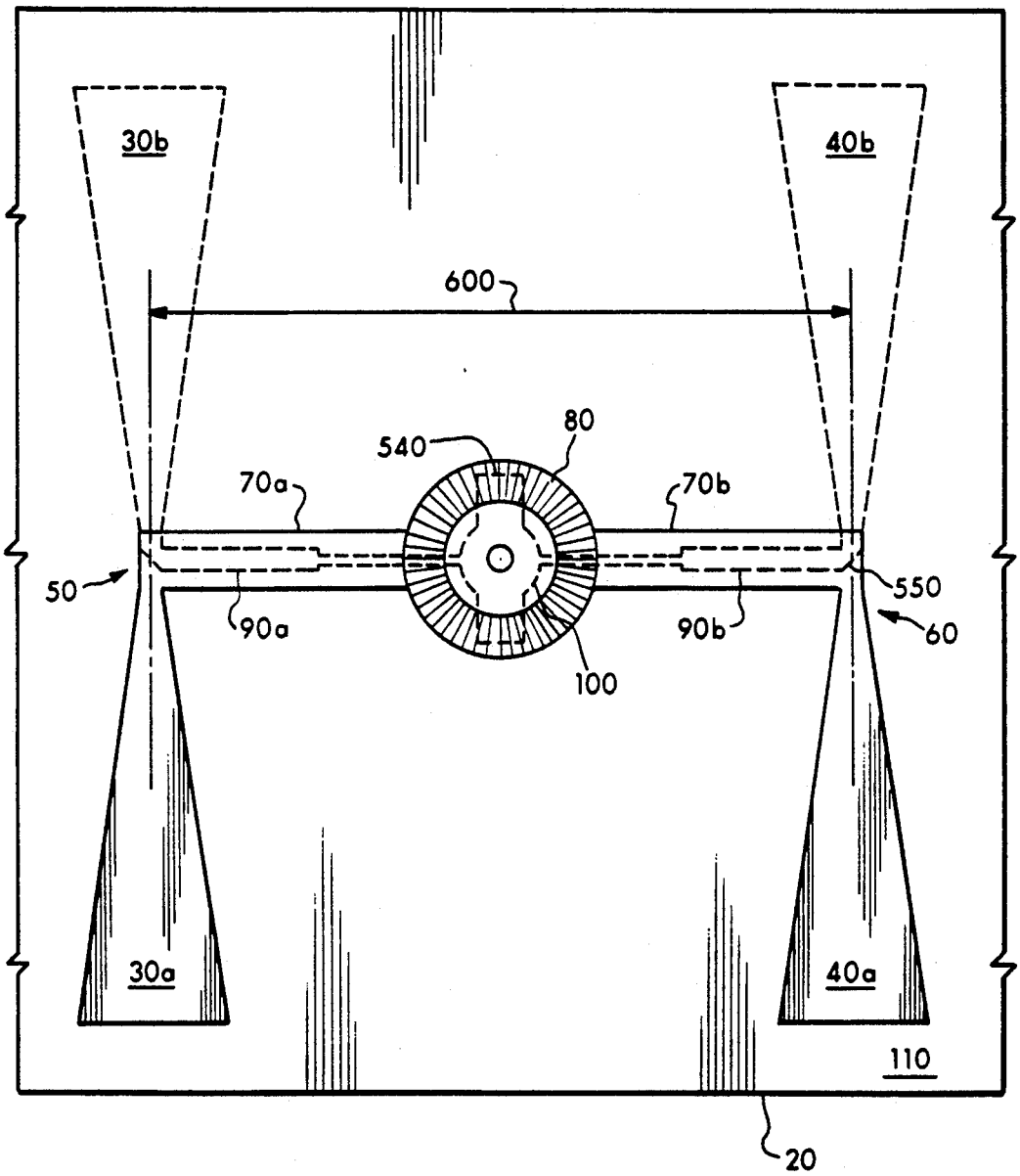
FIG. 6 is a front planar view of the stacked dual dipole feed of the present invention setting forth the relationship of the front surface to the back surface of the printed circuit board.

In FIG. 6, the geometric mask relationship or positioning of the front of the PC board to the rear of the PC board 20 is shown. Note that dipole 50 is formed dipole element from halves 30*a* and 30*b* which are aligned with each other to function as a dipole having element half 30*a* physically spaced by the thickness of PCB 20 from the other half 30*b*. This thickness of the preferred invention is 0.063 inches. The same relationship exists between the element halves 40*a* and 40*b* for dipole 60. Likewise, the traces 70 and 90 as well as the rings 80 and 100 are similarly spaced from each other by the thickness of PCB 20. Note also that the inner ring 100 is centered within the outer ring 80. The traces 90 are centered underneath the traces 70.

In FIGS. 4, 5, and 6, the details of the stacked dual dipole feed of the present invention are set forth with actual dimensions. For the S-band frequency range of 2000 to 3000 MHz, these dimensions are critical for optimum performance. It is to be expressly understood that some variation in the dimensional tolerances set forth above could be tolerated within the teachings of the present invention. More importantly, while these dimensions are important in the S-band of frequencies, it is to be expressly understood that such dimensions will vary if the stacked dipole arrangement of the present invention is adapted to different frequencies outside the S-board or even to precise frequencies within the S-band.

4. Operation of the Dual Dipole Feed 10

In the following, the operation of the stacked dual dipole feed 10 of the present invention will be discussed.

5. Stacking of Dipoles 50, 60

When two dipoles are stacked (i.e., dipole 50 and dipole 60) on PCB 20, as shown in FIG. 6, the gain increases as they are further separated 600 (assuming zero loss in combiner and transmission lines). The tradeoff, however, is that as the distance 600 increases grating side lobes appear and increase in gain as the main beam-width narrows. With further separation beyond the effective aperture dimension, the gain in the main beam then plateaus. The aperture cross-section of a dipole is an ellipse with its foci lying on the elements of the dipole (i.e., element halves 30*a*, 30*b* of dipole 50 or element halves 40*a*, 40*b* of dipole 60). When the dipole is in a horizontal position, this ellipse has a wavelength width of approximately 0.75 lambda and a wavelength height of approximately 0.25 lambda. If the spacing 600 between the two dipoles 50, 60 were less than about 0.25 lambda in wavelength then the near 3 dB combination gain would be sacrificed as the effective apertures overlap. Under the teachings of the present invention, therefore, the spacing 600 that was arrived at in the matching/combiner network is less than about 0.40 lambda in wavelength which avoids the aforesaid aperture overlap and minimizes interaction with the unbalanced coaxial feed and mechanical support without introducing significant side lobes. As will be explained subsequently, introducing a properly formed sub-reflector reduces the grating side lobes even further.

b. Function of Shunt Capacitance 540 and Combiner 560

The shunt capacitance 540 provides impedance matching over the desired frequency of the present invention which is the S-band between 2.0 and 3.0 GHz. The shunt capacitance 540 is sufficient to compensate for the series inductance created by the dual dipole feed. The two dipoles 50 and 60 represent two 50 ohm balanced loads which are being combined and fed into a 50 ohm unbalanced load.

The transitions 560 between trace sections 500 and 520 represents the cross-over point between a higher and lower impedance section of transmission line. Trace sections and 500 are 50 mils wide 510 and have a typical impedance of 75.2 ohms whereas trace sections 520 are 25 mils wide as shown by width 530 and have a typical impedance of 70.7 ohms. The dual section stepped impedance values increases the usable bandwidth of the circuit. The combined length of trace sections 500 and 520 of each trace 90 in FIG. 5 represents a quarter-wave length of a 70.7 ohm transmission line and is a design which can be attributable to a three port, in-line power combiner design introduced by Wilkinson. The Wilkinson design consists of a pair of quarter-wave sections having a characteristic impedance of 70.7 ohms which are series terminated at the output with a 100 ohm resistor. The 70.7 oh represents the geometric mean between 50 and 100 ohms and is the necessary to raise impedance of each dipole to 100 ohms so when the output of each dipole is combined in phase in parallel at connection point 140 the impedance will again be 50 ohms. However, as will be explained with respect to FIG. 11, the cross-polarized signals are out-of-phase so as to go through a null at 0° and 180°. It is to be noted, however, that the design of the present invention does not require the use of any external component such as a resistor as found in the Wilkinson approach.

Shunt capacitance 540, traces 70*a*, 70*b*, 90*a*, 90*b*, outer ring 80 and inner ring 100 contribute to the phase combining, impedance matching and transition from balanced dipole to unbalanced coaxial cable.

5. Feed Housing 700 and Reflector 720

Figure 7:
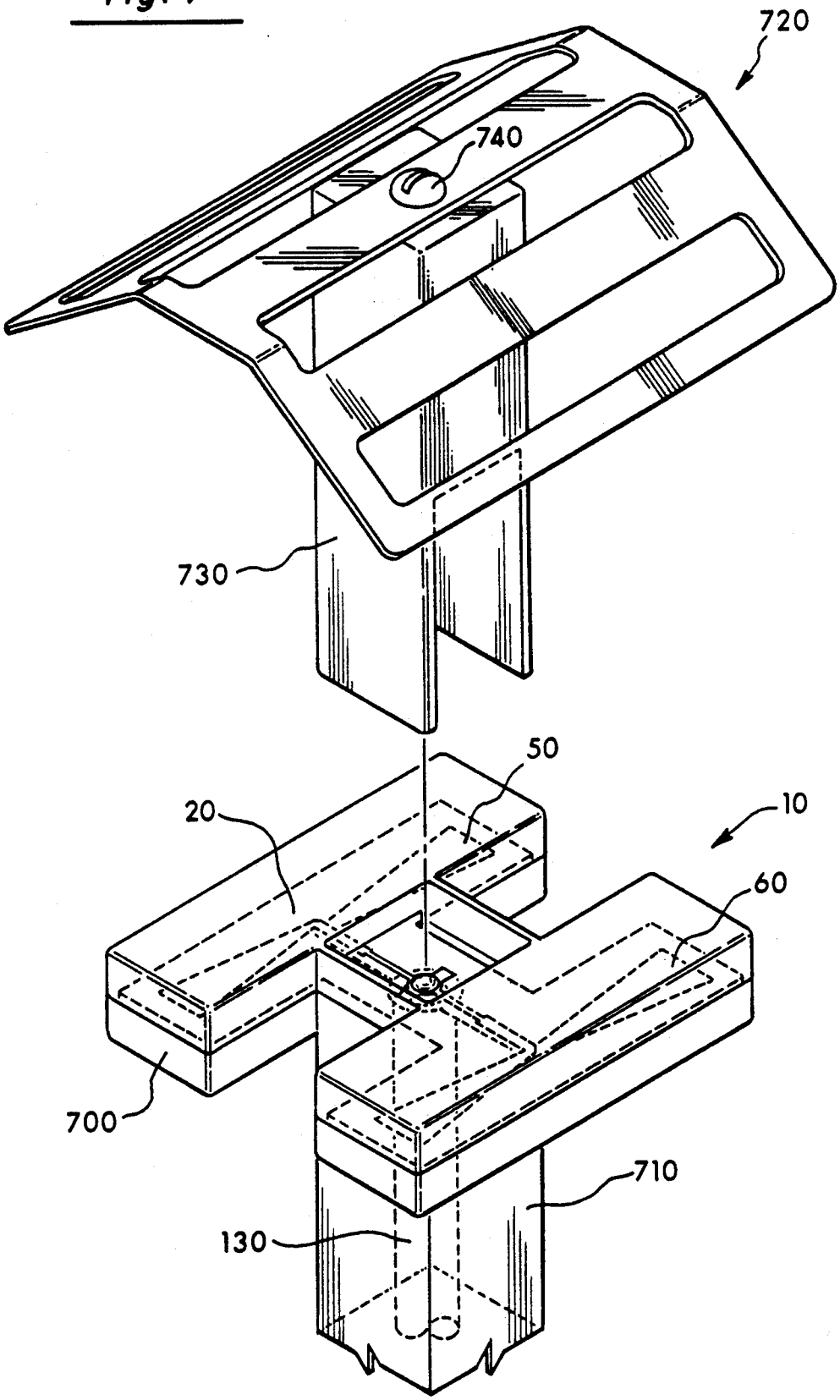
FIG. 7 is a perspective view of the reflector and feed housing of the present invention.

FIG. 7 is a perspective view of the feed 10 of the present invention mounted in a housing 700 on a support mast 710 which is mounted to the center of a parabolic antenna such as that described in the above-identified related patent application. Above the housing 700 is a sub-reflector 720 which is mounted to a second support post 730. The sub-reflector is connected with a set screw or rivet 740 to the support post 730.

Figure 9:
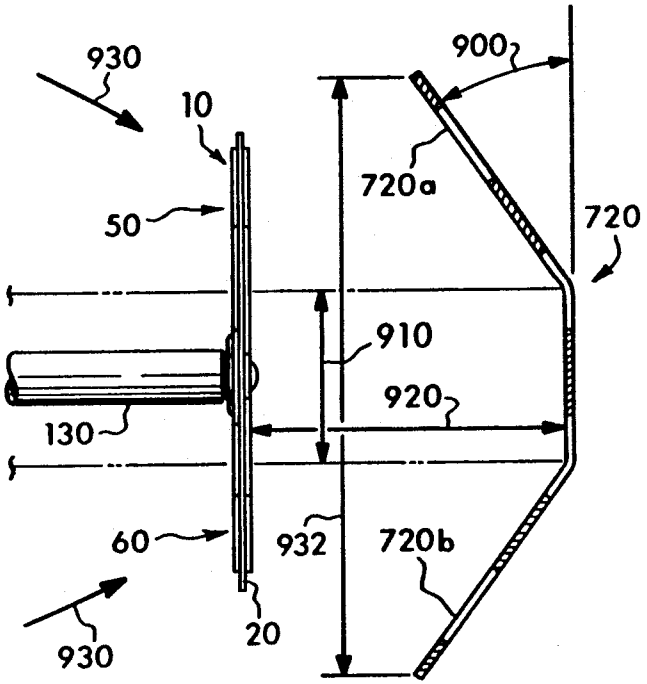
FIG. 9 is a side view showing the spacing relationships between the reflector and the stacked dual dipole feed of the present invention.
Figure 8:
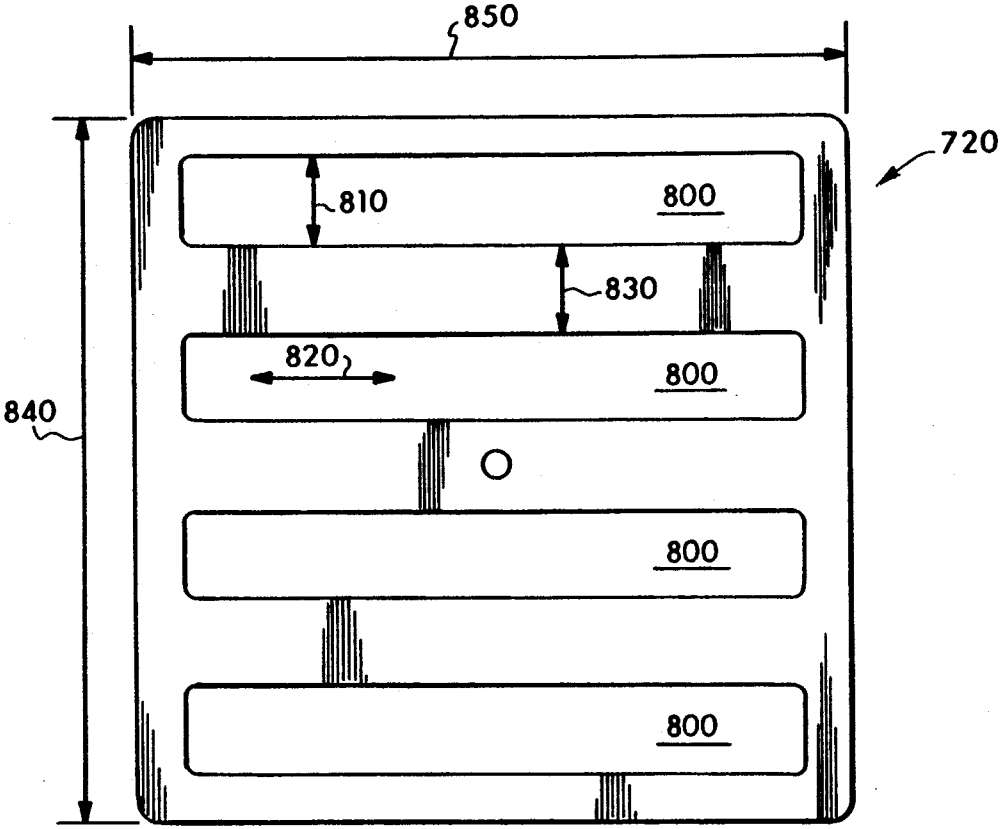
FIG. 8 is a top planar view of the reflector of the present invention.

The details of the sub-reflector 720 are shown in FIGS. 8 and 9. The sub-reflector 720 is preferably stamped out of mill finished aluminum material such as 5052H34. FIG. 8 illustrates the reflector after stamping and before being angularly formed as shown in FIG. 9. The sub-reflector 720 has a series of slots 800 each having a width 810 of about 0.5 inches, in the preferred embodiment, and a length 820 of about 3.5 inches in the preferred embodiment. Each slot is spaced from the other slot by a width of 830 which in the preferred embodiment is about 0.5 inches. The slots are designed to minimize wind loading while maximizing the performance of the antenna. The overall length 840 is about 4.0 inches and the overall width 850 is also about 4.0 inches. As shown in FIG. 9, the sub-reflector 720 is angled 900 at 35 degrees and the point of angle commences at a plateau termination 910 of about 1.0 inch.

In FIG. 9, the relationship between the subreflector 720 and the dual dipole feed 10 of the present invention is set forth. The dual dipole feed 10 is spaced 920 from the sub-reflector 720 in the preferred embodiment by a distance of about 1.7 inches. The dual dipole feed 10 is centered under the sub-reflector 720 as shown in FIG. 7. The dual dipole feed 10 has dipole 50 positioned under element half 720*a* of the sub-reflector and dipole 60 under element half 720*b*. The coaxial cable 130 connected to the feed 10 is delivered down through the square channel 710.

The design of the support 730 is shown square and it is to be expressly understood that any suitable design such as of circular cross-section for the support element 730 may be utilized. The purpose of the support element 730 is to position the subreflector to have the angled sides set above the dipoles 50, 60 a predetermined distance away. Again, it is to be expressly understood that the distances set forth above are designed for the S-band frequency range and that the antenna of the present invention could be suitably modified to function in other frequency ranges or more precisely modified to detect a single frequency within the S-band.

6. Operation of the sub-Reflector

The operation of the sub-reflector with respect to the feed 10 occurs as follows. In FIG. 9, the PCB 20 is oriented in the focal area 920 of the incoming signals generally indicated at 930. As discussed above, the dipoles 50, 60 lies in a horizontal position in this focal area 920 which is an ellipse. Upon introducing the sub-reflector 720, it was discovered that by bending the sides 720*a* and 720*b* and by varying its positioning 920 the grating side lobes generated by the dual dipoles 50 and 60 of the feed 10 were reduced.

As is evident in FIG. 8, the sub-reflector also exhibits low wind load characteristics by having slots 800 formed therein.

c. Operational Characteristics

Figure 10:
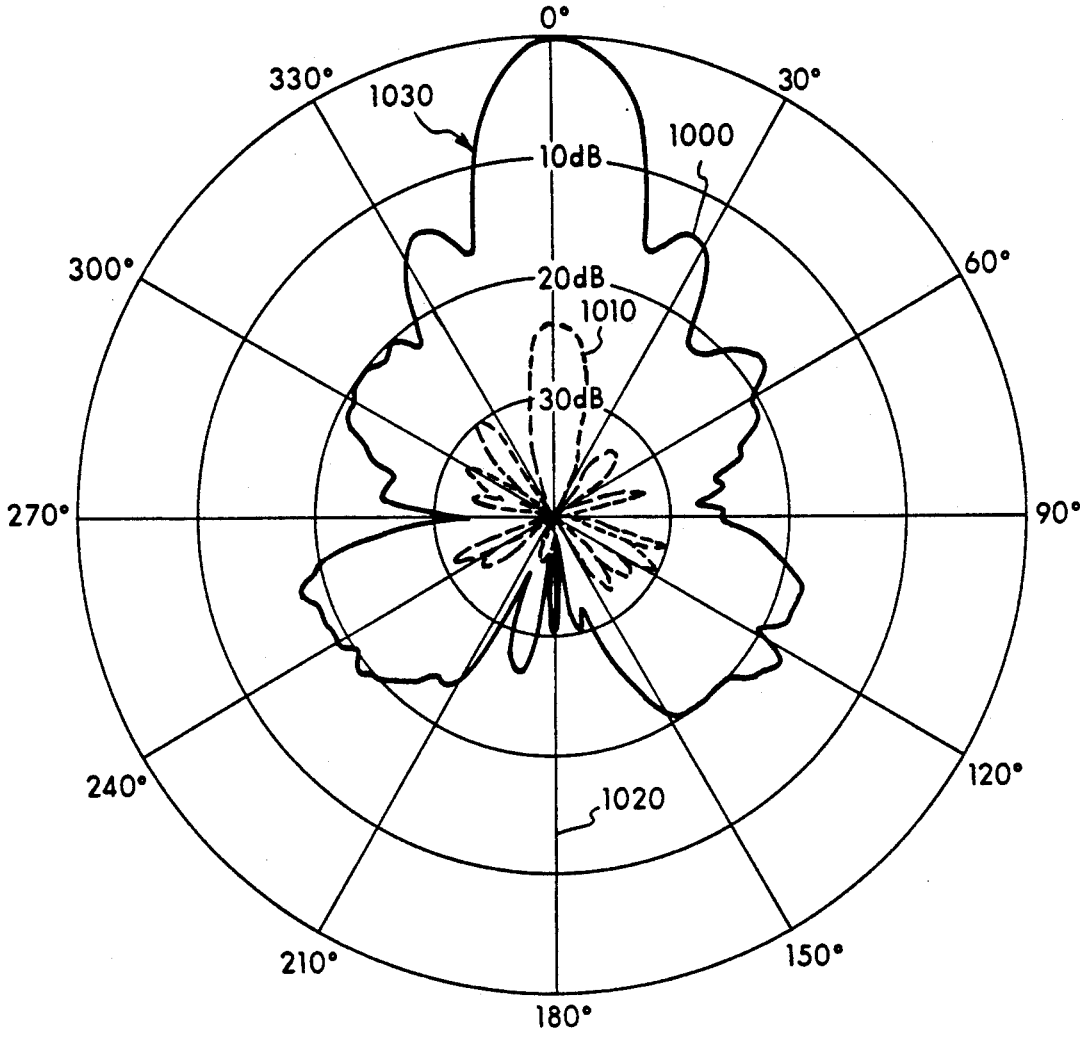
Fig. 10 Prior Art
FIG. 10 is a polar pattern for a conventional Conifer MDS/MMDS antenna.
Figure 11:
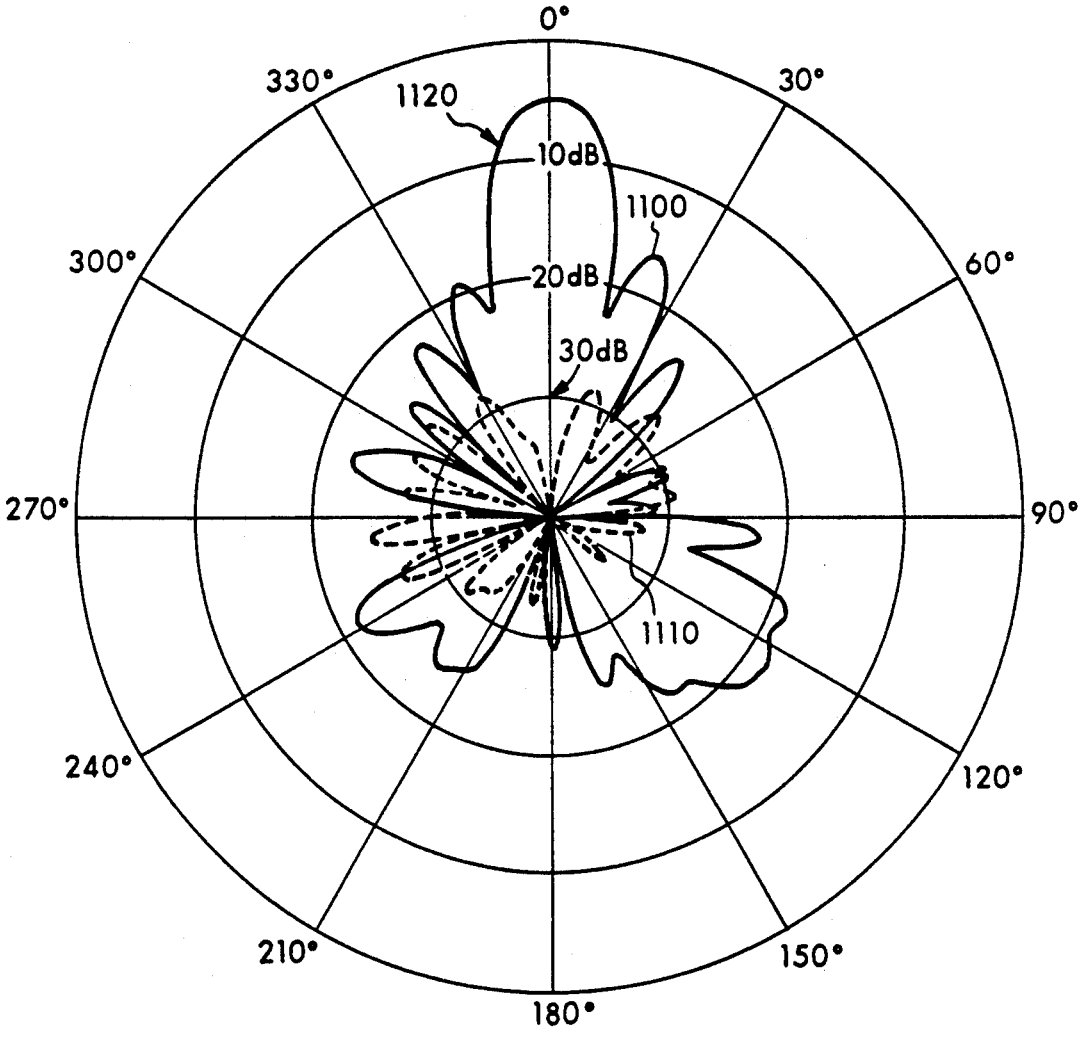

FIG. 11 sets forth the polar pattern of the antenna of the preferred embodiment in comparison to the polar pattern of the conventional antenna set forth in U.S. Pat. No. 4,295,143 and shown in FIG. 10.

In FIG. 10, the solid black line 1000 represents polarized signal reception. The conventional antenna received a 2550 MHz from a transmitter located 40 feet away. The inner-dashed line 1010 represents reception of cross-polarized signals found within the above-identified conventional antenna. It is noted that the cross-polarized signal reception 1010 is approximately 24 dB lower than the polarized signal 1000 at the 0° or on the axis line 1020.

This is to be compared to the polar pattern of the present invention which is set forth in FIG. 11. The antenna of FIG. 14 received a 2.593 GHz signal transmitted 40 feet. The outer solid line 1100 represents polarized signal reception and the smaller dashed line represents the cross-polarized signal 1110. Of significance is that at the 0° and the 180° lines, the cross-polarized signal reception 1110 is null—i.e., the cross-polarized signals from each separate dipole combine together and cancel. This represents a major improvement in cross-polarized signal rejection as compared to the conventional antenna design of FIG. 10 and when compared to other conventional antenna designs. The nulls at 0° and 180° are due to the design of the dual dipole feed of the present invention which is in phase for polarized signals and out of phase for cross-polarized signals.

It is also observed in FIG. 11 that the front lobe 1120 of the present invention is approximately 12.5 percent sharper than the front lobe 1030 of the prior art antenna of FIG. 10. That is, 14° at −3 dB points as compared to 16° of the antenna of FIG. 10. This also improves rejection of unwanted polarized signals.

In FIG. 15, the effect of the sub-reflector 720 on side lobe suppression is shown. The solid line 1500 is the pattern for the angled sub-reflector 720 at the optimum spacing 920 as shown in FIG. 9. The dotted line 1510 represents the sub-reflector 720 not angled, but in a flat orientation at an optimum spacing from the dual dipoles 10. Both measurements were taken at 2.6 GHz. Even at this optimum spacing, side lobes 1520 are clearly present and predominant in comparison to the side lobes 1530 of the angled subreflector. Hence, FIG. 15 fully illustrates the importance of providing the sub-reflector 720 with angled ends. The spacings are approximately 1 dB apart in FIG. 15.

7. Antenna Environment

In FIG. 14 the details of the environment of the present invention are shown. A parabolic low wind load antenna 1410 has two identically formed halves 1420*a* and 1420*b*. These two halves 1420 are interconnected at points 1430 by means of a rivet or the like. The feed housing 700 is located at the focal area 920 of the antenna 1410 and is mounted on a feed support 130. The feed support 130 is interconnected to the antenna 1410 at points 1460. Incoming electromagnetic signals 935 are reflected into the feed housing 700 as shown by lines 930 and a programming signal is picked up and delivered from the antenna over cable 1490. The antenna 1410 is designed to receive "S-Band" (2.0/3.0 GHz) frequencies. From the viewpoint of the transmitted signals. 935, the antenna 1410 appears to be electrically solid despite the predetermined spacings. The antenna 1410 has a reflector 720 on the end of support 730 for redirecting reflected signals 930 downwardly into feed 10.

It is to be expressly understood that the claimed invention is not to be limited to the description of the preferred embodiment but encompasses other modifications and alterations within the scope and spirit of the inventive concept.

We claim:

1. A single stacked dual dipole feed for use in the S-band of 2000 to 3000 MHz, said dual dipole feed comprising:

a thin board having conductive material on both sides thereof, a first portion of said feed formed in said conductive material on the front side of said board, said first portion having:

(a) two opposing lower isosceles triangular shaped dipole half elements with the unequal sides extending outwardly on said front side form the centerline of said feed, (b) a front linear trace connecting the apexes of said two opposing lower dipole half elements along said centerline, and (c) an outer circular ring centrally disposed on said front trace between said apexes of said lower half elements, said board having a formed hole through said board, said formed hole being centrally located in said second portion having:

a second portion of said feed formed in said conductive material on the rear side of said board, said second portion having:

(a) two opposing upper isosceles triangular shaped dipole half elements with the unequal sides extending outwardly on said rear side from said centerline of said feed, said opposing upper extending half elements being of the same dimension as said lower half elements, (b) a rear linear trace connecting the apexes of said two opposing upper dipole half elements, said rear trace being centrally positioned over said front trace along said centerline, said rear trace having a combiner formed thereon for combining the outputs of said half elements, and (c) an inner circular ring centrally disposed on said rear trace between said apexes of said upper half elements, said inner circular ring being centrally located over said formed hole, said first and second portions cooperating together to feed said signals in said S-band.

2. The dual dipole feed of claim 1 further comprising shunt capacitance located on opposing sides of said inner circular ring orthogonal to said rear trace.

3. The dual dipole feed of claim 1 further comprising:

a connector mounted to said board, said connector having its outer conductor soldered to said outer circular ring and having its inner conductor extending through said formed hole and soldered to said inner circular ring, said first portion of said feed being electrically connected to said outer conductor of said coaxial cable and said second portion of said feed being electrically connected to said inner conductor of said connector so that two stacked dipoles are formed form said dipole half elements.

4. The dual dipole feed of claim 1 further comprising a barrel connector soldered to said outer circular ring, said barrel connector having a formed hole extending therethrough and centrally located over said formed hole of said circuit board, and a coaxial cable mounted to said barrel connector and to said board, said coaxial cable having its outer conductor affixed to said barrel connector and having its inner conductor extending through said formed hole of said barrel connector and through said formed hole of said board and soldered to said inner circular ring, said first portion of said feed being electrically connected to said outer conductor of said coaxial cable and said second portion of said feed being electrically connected to said inner conductor of said coaxial cable so that two stacked dipoles are formed from said dipole half elements.

5. The stacked dual dipole feed of claim 1 wherein each of said upper and lower dipole half elements has a length of about 1.21 inches, wherein each of said unequal sides equals about 0.4 inches and wherein each of said apexes has a width of about 0.05 inches.

6. The stacked dual dipole feed of claim 1 wherein the diameter of said outer circular ring is about 0.5 inches, the inner radius of said outer circular ring is about 0.15 inches, and wherein the diameter of the inner circular ring has an outer radius of about 0.11 inches and an inner radius of about 0.05 inches.

7. The stacked dual dipole feed of claim 1 further comprising a sub-reflector spaced from said board for maximizing the gain of said antenna and for minimizing the grating side lobes of said antenna, said sub-reflector having angles sides located above said dipole half elements.

8. An antenna for use in the frequency range of 2000 to 3000 MHz, said antenna comprising:

a board having conductive material formed on first and second sides thereof, two dipoles stacked on said board, each of said dipoles having a first one-half element etched in said conductive material on said first side of said board and a second one-half element etched in said conductive material on the second side of said board, said dipoles being oriented to combine polarized signals in phase with each other and to further combine non-polarized signals out of phase with each other, a first conductive trace interconnecting said first one-half elements of said two dipoles together, said first conductive trace being etched in said conductive material on said first side along the centerline of said antenna, a first circular conductive pad etched in said conductive material on said first conductive trace at a mid-point between said two dipoles on said first side, a second conductive trace interconnecting said second one-half elements of said two dipoles together, said second conductive trace being etched in said conductive material on said second side along said centerline, a second circular conductive pad etched in said conductive material as part of said second conductive trace directly opposing said first circular conductive pad, a hold formed through the center of said first circular conductive pad, said board, and the center of said second circular conductive pad, means connected to said first and second circular conductive pads for feeding said signals polarized signals, and means etched on said second conductive trace in said conductive material and connected between said second circular pad and each of said second one-half elements for combining phase the polarized signals from each of said dipoles, said combining means further matching the impedance of said two dipoles to the impedance of said feeding means, said two dipoles cooperating together to receive said channels in said frequency range.

9. The antenna of claim 8 wherein the diameter of said first circular pad is greater than the diameter of said second circular pad.

10. The antenna of claim 8 further comprising a sub-reflector spaced from said two stacked dipoles for maximizing the gain of said antenna and minimizing grating side lobes of said antenna.

11. The antenna of claim 8 further comprising shunt capacitance etched on opposing sides of said second circular conductive pad orthogonal to said second conductive trace.

12. The antenna of claim 8 further comprising:

said feeding means having an inner conductor and a ground conductor, the end of said feeding means having its inner conductor delivered through said formed hole to connect to said second circular pad and having its ground conductor connected to said first circular pad.

13. The antenna of claim 8 further comprising:

a barrel connector soldered to said first circular conductive pad, said barrel connector having a hole formed there through wherein said formed hole of said barrel connector aligns with said formed hole through said board, said feeding means having an inner conductor and a ground shield, the end of said feeding means having its inner conductor delivered through said formed hole of said barrel connector and through said formed hole of said board to connect to said second circular pad and having its ground shield connected to said barrel connector.

14. The antenna of claim 8 wherein each of said two stacked dipoles have a balanced 50 ohm impedance.

15. The antenna of claim 8 wherein said combining means etched on said second conductive trace has a first thicker region connected to said second one-half element and a second thinner region connected to said second circular conductive pad and wherein the impedance of said first region is 75.2 ohms and wherein the impedance of said second region is 70.7 ohms.

16. The antenna of claim 15 wherein said first thicker region has a width of about 0.050 inches and wherein said second thinner region has a width of about 0.025 inches so that the overall impedance of the second conductive trace is 70.7 ohms.

17. A dipole feed for use in the frequency range of 2000 to 3000 HMz, said dipole feed comprising:

a board having conductive material formed on first and second sides thereof, two 50 ohm balanced dipoles stacked on said board, each of said dipoles having a first one-half element etched in said conductive material on said first side of said board and a second one-half element etched in said conductive material on the second side of said board, each of said dipoles being oriented to output polarized signals in phase with each other and to further output non-polarized signals out of phase with each other, said dipoles being spaced from each other at a wavelength spacing in the range of about 0.25 lambda to about 0.40 lambda, a first conductive trace interconnecting said first one-half elements of said two dipoles together, said first conductive trace being etched in said conductive material along the centerline of said antenna on said first side, a first circular conductive pad etched in said conductive material on said first conductive trace at a mid-point between said two dipoles on said first side, a second conductive trace interconnecting said second one-half elements of said two dipoles together, said second conductive trace being etched in said conductive material along said centerline on said second side, a second circular conductive pad etched in said conductive material on said second conductive trace directly opposing said first circular conductive pad, a hole formed through the center of said first circular conductive pad, said board, and the center of said second circular conductive pad, means connected to said first circular pad and through said formed hole to said second circular pad for delivering said polarized signals from said dipoles, said two dipoles cooperating together to feed said channels in said frequency range.

18. The dipole feed of claim 17 wherein the diameter of said first circular pad is greater than the diameter of said second circular pad.

19. The dipole feed of claim 17 further comprising a sub-reflector spaced from said two stacked dipoles for maximizing the gain of said antenna and minimizing grating side lobes of said antenna.

20. The dipole feed of claim 17 further comprising shunt capacitance etched on opposing sides of said second circular conductive pad orthogonal to said second conductive trace.

21. The dipole feed of claim 17 further comprising means on said second trace and connected between said second circular pad and each of said second one-half elements for combining in phase the power from each of said dipoles, said combining means further matching the impedance of said two dipoles to the impedance of said delivering means.

22. The antenna of claim 21 wherein said combining means etched on said second conductive trace has a first thicker trace connected to said second one-half element and a second thinner conductive trace connected to said second circular conductive pad and wherein the impedance of the first conductive trace is 75.2 ohms and wherein the impedance of the second conductive trace is 70.7 ohms.

23. The antenna of claim 22 wherein the first thicker trace portion of said second conductive trace has a width of about 0.025 inches and wherein said second thinner conductive trace has a width of about 0.05 inches so that the overall impedance of the second conductive trace is 70.7 ohms.

24. The dipole feed of claim 17 wherein said delivering means comprising a connector having an inner conductor and a ground conductor, the end of said connector having its inner conductor delivered through said formed hole to connect to said second circular pad and having its ground conductor connected to said first circular pad.

25. The dipole feed of claim 17 wherein said delivering means comprises:

a barrel connector connected to said first circular pad, said barrel connector having a formed hole extending there through and centered over said formed hole in said board, a connector having an inner conductor and a ground shield, the end of said connector having its inner conductor delivered through said form of said barrel connector and of said board to connect to said second circular pad and having its ground shield connected to said barrel connector.

26. An antenna responsive to signals in the S-band comprising:

a reflector for reflecting said signals into a focal area, a board having conductive material on first and second sides thereof, a single stacked dual dipole feed having first and second one-half elements, said first one-half element etched on said first side and said second one-half element etched on said second side, of said board, a connector orthogonally connected to said board and electrically directly connected to said conductive material of said stacked dual dipole feed;

means engaging said board for holding said stacked dual dipole feed in said focal area of said reflected signals, a sub-reflector having angled sides located above said single stacked dual dipole feed, means connected to said holding means for supporting said sub-reflector at a predetermined distance above said holding means, said feed responsive to said signals in said S-band.

27. The antenna of claim 26 further comprising:

a first conductive trace interconnecting said first one-half elements of said single stacked dual dipole feed together, said first conductive trace being etched in said conductive material on said first side along the centerline of said antenna, a first circular conductive pad etched in said conductive material and said first conductive trace at a mid-point between said single stacked dipole feed on said first side, a second conductive trace interconnecting said second one-half elements of said single stacked dipole feed together, said second conductive trace being etched in said conductive material on said second side along said centerline, a second circular conductive pad etched in said conductive material as part of said second conductive trace directly opposing said first circular conductive pad, a hold formed through the center of said first circular conductive pad, said board, and the center of said second circular conductive pad.

28. The antenna of claim 27 wherein the diameter of said first circular pad is greater than the diameter of said second circular pad.

29. The antenna of claim 27 further comprising shunt capacitance etched on opposing sides of said second circular conductive pad orthogonal to said second conductive trace.

30. The antenna of claim 27 further comprising:

a connector having an inner conductor and a ground shield, the end of said connector having its inner conductor delivered through said formed hole to connect to said second circular pad and having its ground shield connected to said first circular pad.

31. The antenna of claim 27 further comprising:

a barrel connector soldered to said first circular conductive pad, said barrel connector having a hole formed there through wherein said formed hole of said barrel connector aligns with said formed hole through said board, a connector having an inner conductor and a ground shield, the end of said connector having its inner conductor delivered through said formed hole of said barrel connector and through said formed hole of said board to connect to said second circular pad and having its ground shield connected to said barrel connector.

32. The antenna of claim 27 wherein each of said two stacked dipoles have a balanced 50 ohm impedance.

33. The antenna of claim 27 wherein said combining means etched on said second conductive trace has a first thicker region connected to said second one-half element and a second thinner region connected to said second circular conductive pad and wherein the impedance of said first region is 75.2 ohms and wherein the impedance of said second region is 70.7 ohms.

34. The antenna of claim 33 wherein said first thicker region has a width of about 0.050 inches and wherein said second thinner region has a width of about 0.025 inches.

35. An antenna responsive to signals in the S-band comprising:

a reflector for reflecting said signals into a focal area, a board having conductive material on both sides thereof, a single stacked dual dipole feed having a pair of dipoles, said pair of dipoles being etched in said conductive material with one one-half of each dipole etched on one of said board, means for interconnecting said pair of dipoles together so as to place polarized signals in phase with each other and to place non-polarized signals out of phase so that the non-polarized signals have a null at 0° and 180°, a connector connected to said board and electrically connected to said interconnecting means, means engaging said board for holding said stacked dual dipole feed in said focal area of said reflected signals, a sub-reflector having angled sides located above said pair of dipoles, means connected to said holding means for supporting said sub-reflector at a predetermined distance above said holding means, said feed responsive to said signals in the said S-band.

36. A single stacked dual dipole feed responsive to signals in the S-band of 2,000 to 3,000 MHz, said single stacked dual dipole feed comprising:

a thin board having conductive material on both sides thereof, a first portion of said feed formed in said conductive material on the front side of said board, said first portion having:

(a) two opposing lower isosceles triangular shaped dipole half elements with the unequal sides extending outwardly on said front side from the centerline of said feed, wherein each of said lower isosceles triangular shaped dipole half elements has a length of about 1.2 inches and wherein each of said unequal sides equals about 0.4 inches, said lower half elements being spaced at a wavelength spacing in the range of about 0.25 lambda to about 0.40 lambda, (b) a front linear trace connecting the apexes of said two opposing lower dipole half elements along said centerline, said front linear trace having a width of about 0.15 inches and (c) an outer circular ring centrally disposed on said front trace between said apexes of said lower half elements, said outer circular ring having an outer diameter of about 0.5 inches, said board having a formed hole through said board, said formed hole being centrally located in said outer circular ring, a second portion of said feed formed in said conductive material on the rear side of said board, said second portion having:

(a) two opposing upper isosceles triangular shaped half elements with the unequal sides extending outwardly on said rear side from said centerline of said feed, said opposing upper extending half elements being of the same dimension and spacing as said lower half elements, (b) a rear linear trace connecting the apexes of said two opposing upper dipole half elements, said rear trace being centrally positioned over said front linear trace along said centerline, said rear trace having a first thicker region connected to said second one-half element and a second thinner region connected to said first thicker region and wherein said first thicker region has a width of about 0.05 inches and wherein said second thinner region has a width of about 0.025 inches, and (c) an inner circular ring centrally disposed on said rear trace between said apexes of said upper half elements, said inner circular ring being centrally located over said formed hole and having an outer diameter of about 0.2 inches, (d) shunt capacitance located on opposing sides of said inner circular ring orthogonal to said rear trace, said first and second portions cooperating together to respond to said signals in said S-band, and means connected to said outer and inner circular rings for delivering said S-band signals.

37. A single stacked dual dipole feed responsive to signal in the S-band of 2,000 to 3,000 Mhz, said feed comprising:

a thin board having conductive material on both sides thereof, a first portion of said feed formed with said conductive material on the front side of said board, said first portion having:

(a) two opposing lower isosceles triangular shaped dipole half elements with the unequal sides extending outwardly on said front side from the centerline of said feed, wherein each of said lower isosceles triangular shaped dipole half elements has a length of about 1.2 inches and wherein each of said unequal sides equals about 0.4 inches, (b) a front linear trace connecting the apexes of said two opposing lower dipole half elements along said centerline, said front linear trace having a width of about 0.15 inches and (c) an outer circular ring centrally disposed on said front trace between said apexes of said lower half elements, said outer circular ring having an outer diameter of about 0.5 inches, said board having a formed hole through said board, said formed hole being centrally located in said outer circular ring, a second portion of said feed formed with said conductive material on the rear side of said board, said second portion having:

(a) two opposing upper isosceles triangular shaped half elements with the unequal sides extending outwardly on said rear side from said centerline of said feed, said opposing upper extending half elements being of the same dimension as said lower half elements, (b) a rear linear trace connecting the apexes of said two opposing upper dipole half elements, said rear trace being centrally positioned over said front linear trace along said centerline, said rear trace having a first thicker region connected to said second one-half element and a second thinner region connected to said first thicker region, and (c) an inner circular ring centrally disposed on said rear trace between said apexes of said upper half elements, said inner circular ring being centrally located over said formed hole and having an outer diameter of about 0.2 inches, (d) shunt capacitance located on opposing sides of said inner circular ring orthogonal to said rear trace, said first and second portions cooperating together (i) to output polarized signals in phase with each other and (ii) to cancel non-polarized signals out of phase with each other from said signals in said S-band, and means connected through said hole to said outer and inner circular rings for delivering said S-band signals from said first and second portions.

* * * * *